United States Patent [19]

Bertoli

[11] 4,361,003

[45] Nov. 30, 1982

[54] DEVICE FOR SPLICING TEXTILE YARNS WITH THE AID OF COMPRESSED AIR

[75] Inventor: Luciano Bertoli, Salo', Italy

[73] Assignee: Mesdan S.p.A., Brescia, Italy

[21] Appl. No.: 272,028

[22] Filed: Jun. 9, 1981

[30] Foreign Application Priority Data

Jun. 13, 1980 [IT] Italy ..... 22767 A/80

[51] Int. Cl.[3] ..... B65H 69/06; D02J 1/08

[52] U.S. Cl. ..... 57/22

[58] Field of Search ..... 57/22, 23, 350, 261, 57/263; 28/271–274

[56] References Cited

U.S. PATENT DOCUMENTS 3,581,486 6/1971 Dibble ..... 57/22
3,633,352 1/1972 Marriner ..... 57/22
3,668,852 6/1972 Fusco et al. ..... 57/22
3,822,538 7/1974 Cardell ..... 57/22
4,217,749 8/1980 Rohner et al. ..... 57/261

*Primary Examiner*—John Petrakes
*Attorney, Agent, or Firm*—Lackenbach, Siegel, Marzullo, Presta & Aronson

[57] ABSTRACT

In a device for splicing textile yarns by admixing and intermingling the component fibers thereof, a mechanical unit is provided which essentially comprises thread-clamping members comprised of fixed component parts formed pairwise on the sidewalls of the machine in an advanced position relative to the fiber-blending chamber and to the cutting members, the latter cutting members being adjustably actuated by actuators operatively connected to the blending-chamber lid.

10 Claims, 16 Drawing Figures

DEVICE FOR SPLICING TEXTILE YARNS WITH THE AID OF COMPRESSED AIR

This invention relates to a device for splicing textile yarns by admixing and intermingling the fibers with the aid of compressed air.

In the textile art, knotting machines are known, which are adapted to conjoin two yarns by the formation of a knot. These fastening knots involve disturbances during progress of the further processing of the yarns on the textile machines, because they are points in which the even continuity of the yarn is discontinued.

In order to offset such a drawback, systems and apparatus have been suggested which are capable of splicing textile yarns without knotting them together, a few of these systems acting by admixing and intermingling of the component fibers with the aid of compressed air.

These machines substantially comprise a blending chamber of an appropriate shape, which can be closed, or not, frontally, by a lid or cover, wherein the ends of the two yarns to be spliced are positioned and into which there opens in central position a compressed air outlet, through which a jet or a blow of air can be introduced in the blending chamber, for a preselected time, that which causes the admixture and intermingling of the fibers of the two yarns and thus their splicing.

This admixing and intermingling run of the fibers in the interior of the blending chamber by the air jet takes place very presumably in two sequential stages: during a first stage, under the abrupt effect of the air blow, the fibers of the yarns tend to be spread about and the original twist is temporarily and partially annulled, the fibers being thus prepared to blending, whereas, during a second stage, the fibers are already spread apart and thus are in the ideal configuration for being admixed and intertwined under the effect of the air whirl in the blending chamber, the original twist tending then to be partially restored by a helical motion of the fibers and this contributes towards making the admixture and thus the splicing of the two textile yarns steadier. It is understood that these stages are immediately consecutive relative to one another and no sharp demarcation line can be drawn therebetween.

In the actual practice of this splicing run by admixture and intertwining of the component fibers of the yarns, it has been ascertained that good results and reliable reproducibility are a function of a number of factors the determination of which is not certainly easy. As a matter of fact, the process is controllable only with difficulty and to a very small extent and, to these difficulties, there is to be added the requirement of having a device available which can be used not only for a certain type of textile yarns but which, conversely, can be used for the knotless splicing of yarns of different characteristics, both from the point of view of the count of yarn and the intrinsic properties of the fibers.

The technical problem that the invention aims to solve thus consists in providing a device for the knotless splicing of textile yarns which makes it possible to obtain, as a result, a steady and reliable splicing also with yarns having different characteristics and which can be adapted to the various requirements by simple adjusting operations, a high degree of reliability and safety being thus achieved.

When facing this problem, it has been ascertained by accurate studies and trials, that two are the factors of quite particular criticality which definitely influence the splicing run and the results which can be obtained.

One of these factors is connected with the positioning of the textile yarns to be sliced in the blending chamber of the device, whereas the other factor has to do with the lengths of the free "tails" of the yarns to be joined together.

At this point, it is fitting to direct attention to the fact that in the machines known heretofore of the kind referred to above, the two yarns to be spliced are positioned substantially parallel to one another in the blending chamber and parallely to the longitudinal axis of this chamber, the two yarns entering with their "heads" at the opposite sides of the chamber and being positioned in correspondence with the chamber bottom wall whereat the port of the entrance of the air blow open. Each yarn is kept latched in the vicinity of the entrance side of the blending chamber and its free "tail" emerges through the opposite side. It has been possible to ascertain that this arrangement is such as to give rise to shortcomings due to the fact that the free "tails" of the two yarns, by their being on the same side of the chamber, that is in correspondence with the bottom wall thereof, just as the clamped ends, might disturbe the splicing run inasmuch as they might interfere with said clamped ends and become entangled therewith without permitting that the fibers may be spread out and mutually intermingled as it would otherwise be desirable.

This circumstance has permitted to establish that it is imperative to act in such a way that, at the positioning of the two yarns in the blending chamber, the free tails are placed in a position away of the clamped ends so as to prevent any detrimental influence as far as this is practicable. This can be achieved, according to the invention, by introducing the two yarns into the blending chamber and positioning them therein in such a way that the yarns take a crossed position relative to one another.

As regards, on the other hand, the other factor mentioned hereinabove, it has been possible to ascertain that, for obtaining a reliable and sturdy splicing of two textile yarns without having too long exceeding lengths of unblended ends, it is necessary to be in a position to determine the optimum length of the free tails of the yarns, so as to have it varied according to the individual characteristics such as the count of the yarns, the staple length, the textile properties and others, of the yarns which must be spliced with the machine in each particular case.

In order to have a device endowed with a certain versatility in use and adaptability to various requirements, it has been ascertained that, in addition to provide to the optimum positioning of the yarns in the blending chamber, it is essential to provide special adjustment means for metering the lengths of the free yarn tails.

Assuming these considerations as a starting point, the invention has thus solved the problems aimed at with a device comprising a blending chamber having a substantially V-shaped cross-sectional outline, with an opening formed centrally in correspondence with the bottom wall thereof and connected via a cutoff valve to a source of compressed air, a lid borne by a movable supporting member for closing said chamber frontally, means for shifting said lid from an inoperative position away of the chamber to a chamber-closing position and vice versa, means synchronized with said lid-shifting means for opening said valve during a preselected time when the lid is in its closed position, fixed guideways for positioning the yarns to be spliced and placed at both sides and away of the blending chamber, members comprised of fixed and movable portions for clamping the yarns and severing means comprised of fixed and movable scissors blades for severing the free tails of the yarns on the opposite side as referred to the chamber and relative to the clamping side, the movable portions of the clamping members and the movable scissors blade of the severing members being controllable in synchronization with the movement of said lid from its inoperative position to the position of closure of the blending chamber, the device being characterized in that the fixed portions of the clamping members and the severing members, respectively, on the two sides of the blending chamber are mutually confronting, that the fixed portions of the clamping members are arranged in an advanced position relative to the direction of motion of the lid from its inoperative position to its closure position, with reference to the blending chamber and also relative to the severing members, and that the supporting member for the lid carries in an adjustable position actuating means for the movable scissors blades.

With these provisions, the two yarns to be spliced must be inserted and positioned in the device so as to cross one another in correspondence with the center of the blending chamber, so that the free tails of the yarns, upon severing, are separated and spaced apart from the clamped ends so that any interference therebetween is prevented as far as practicable and hazards of undesirable entangling are likewise offset.

In addition, by the appropriate adjustment of the means which actuate the movable scissors blades, it is possible to trim the lengths of the free tails of the yarns from a maximum length, if the severing takes place at the end of the closure stroke of the blending chamber lid, to shorter lengths if the severing is advanced in time during the chamber lid closing motion.

To facilitate the correct positioning of the yarns to be spliced in the device, the fixed guides for positioning, which consists of notches formed through the sidewalls of the device, and exactly by two notches for each side thereof, can be equipped with spring-biased clamping means adapted to impress a slight braking action onto the yarns introduced in said guideways.

In correspondence with each sidewall, in either of said thread guides there is inserted either yarn to be spliced and, in the other, the free tail of the other yarn. Now, in order to facilitate the obtention of free tails having lengths variable consistently with the adjustment of said means for actuating the movable scissors blades, it is advantageous to provide control means for the clamping members, associated with notches (or guides) intended to receive the free tails of the yarns, said control means being synchronized with those of the movable scissors blades so as to release the braking action on said free tails, before that the movable scissors blades carry out the severing action.

The foregoing and other features of the device according to the invention will become clearer in more detail from the ensuing description with reference to the accompanying drawings, wherein.

Figure 1:
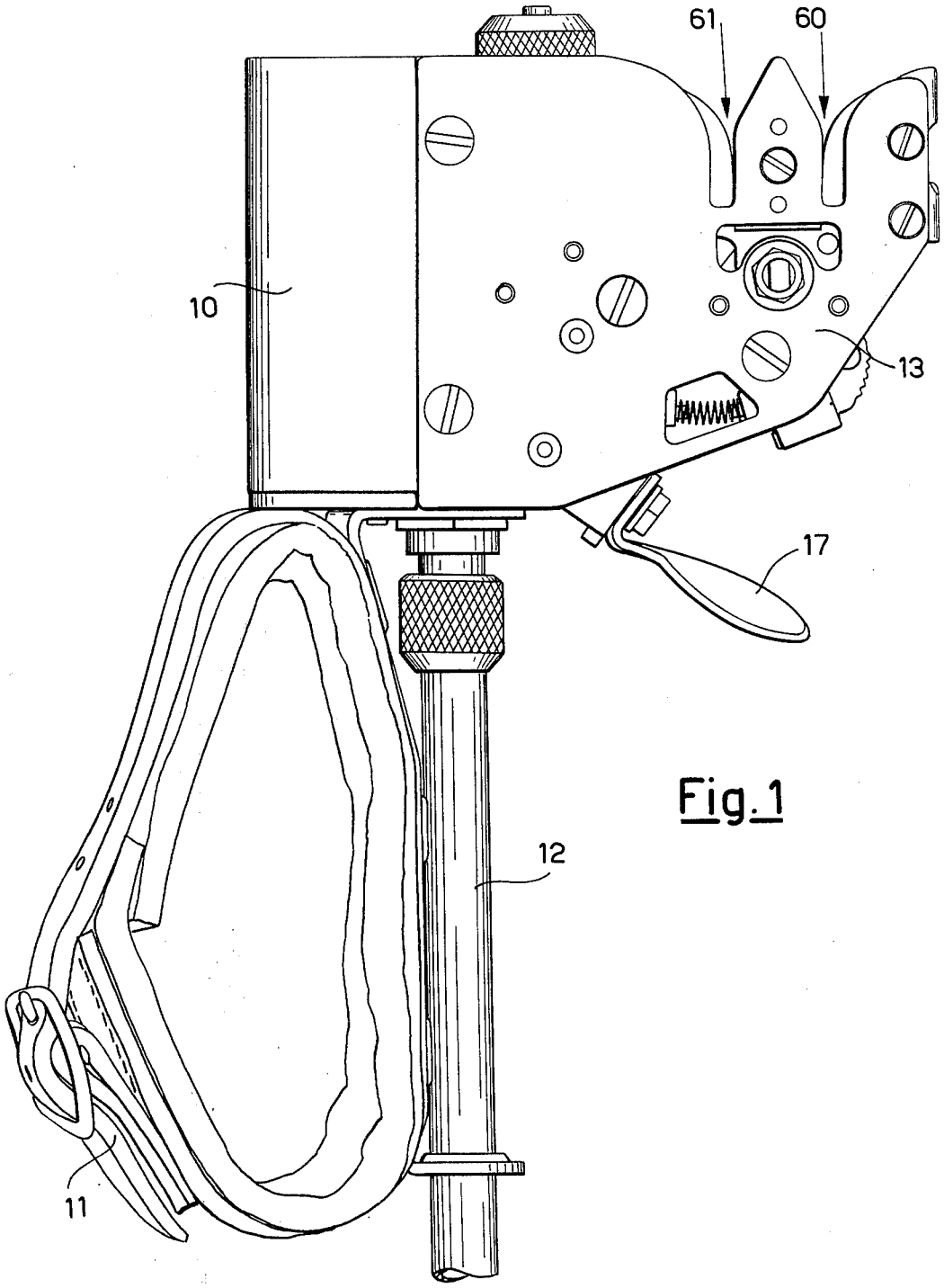
FIG. 1 shows the device in side elevational view.
Figure 2:
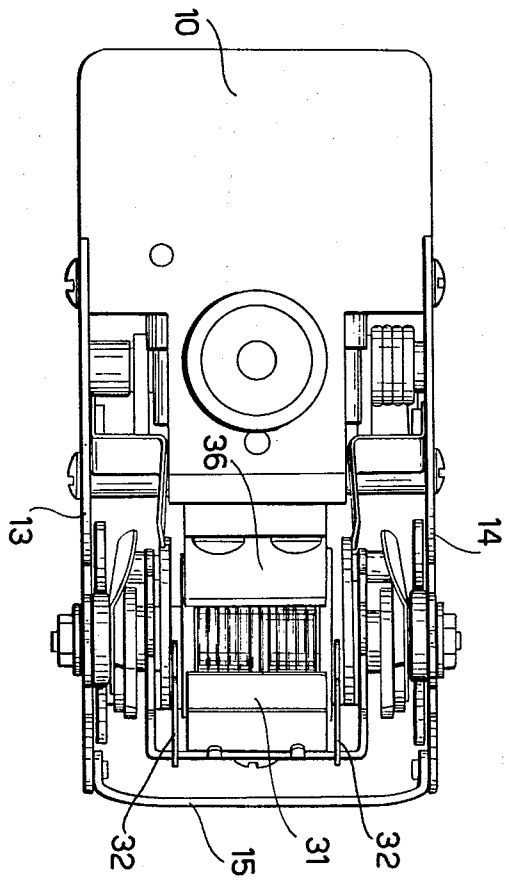
FIG. 2 is a plan view of the device.
Figure 3:
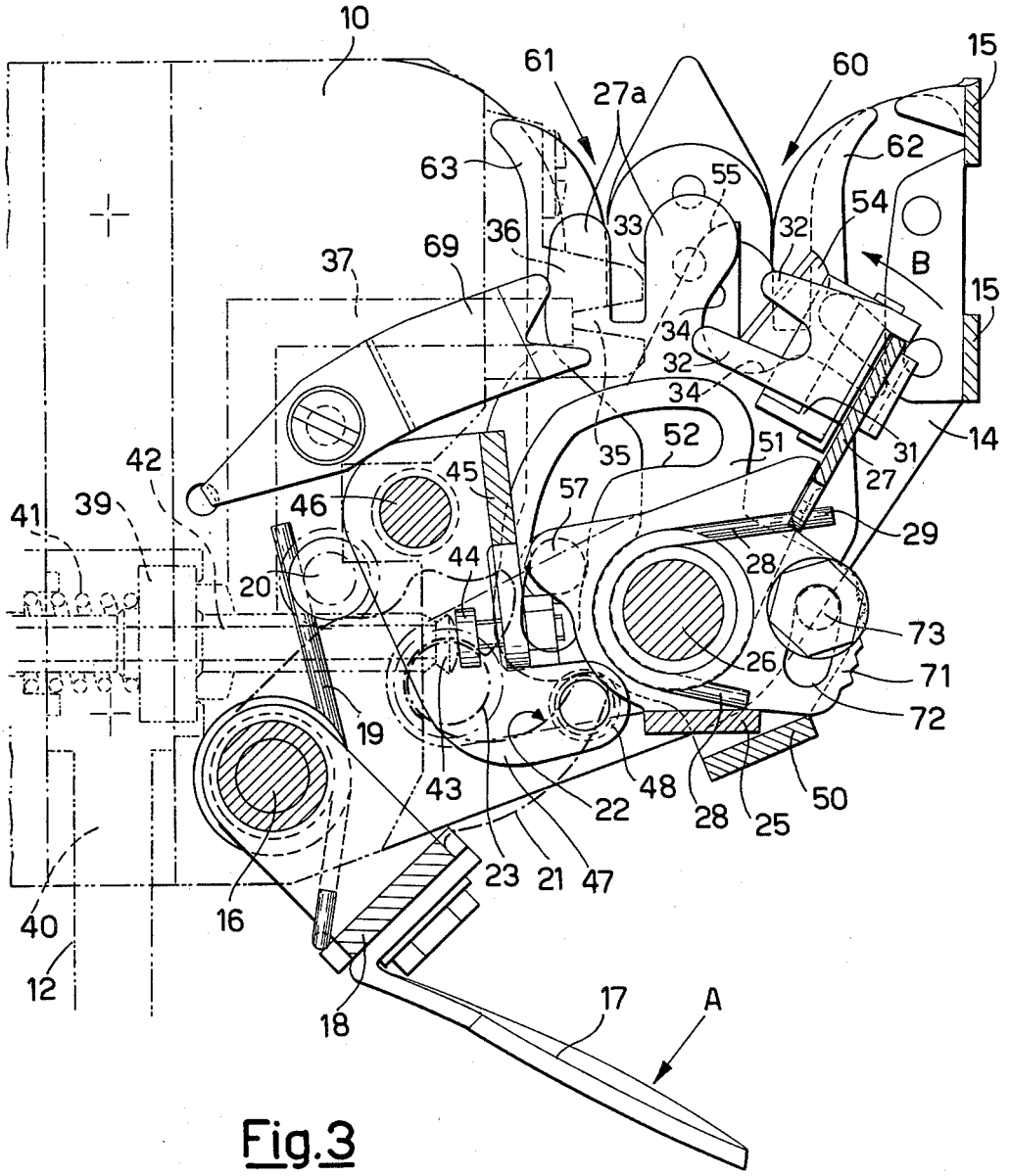
Figure 4:
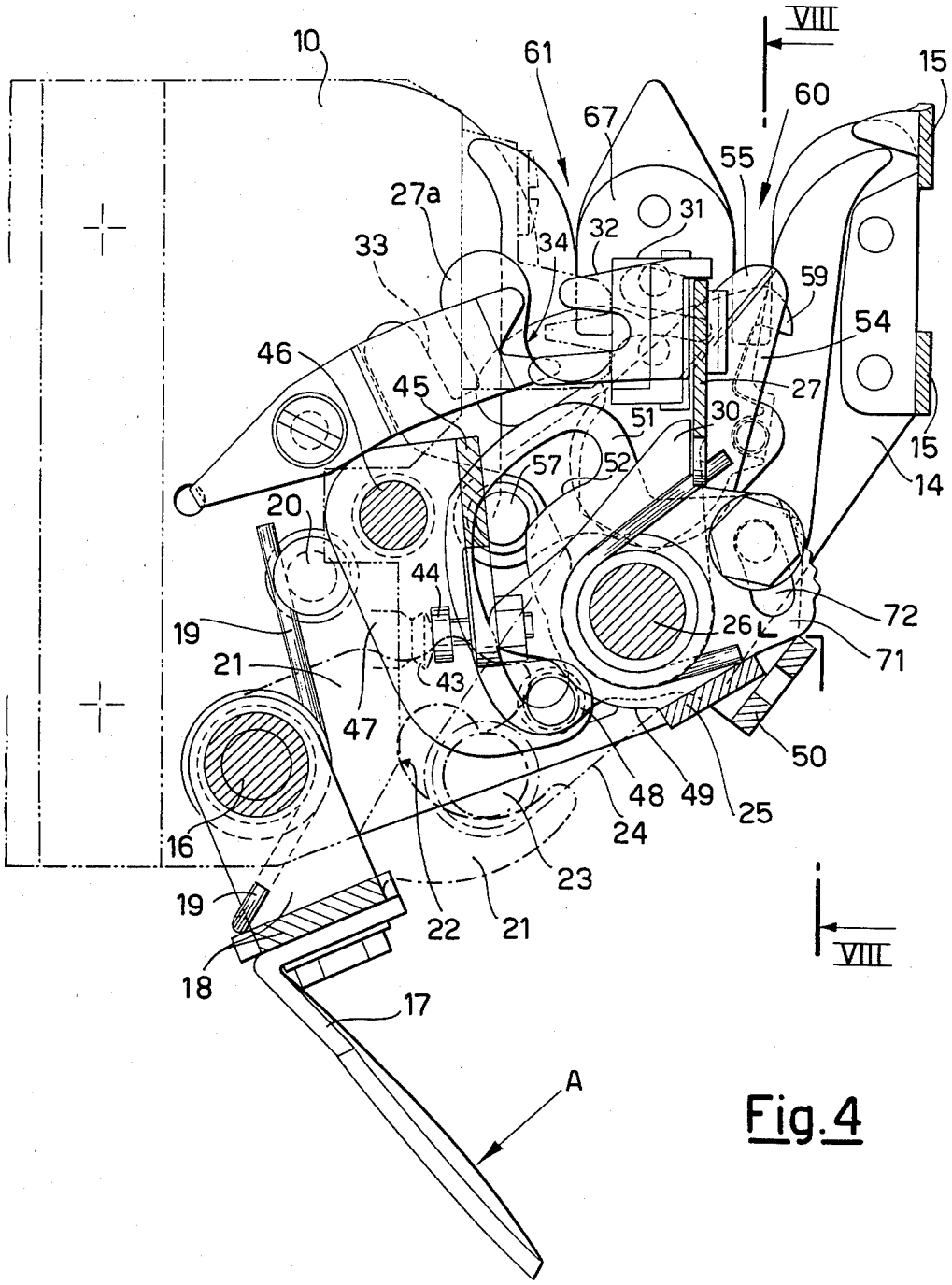
Figure 5:
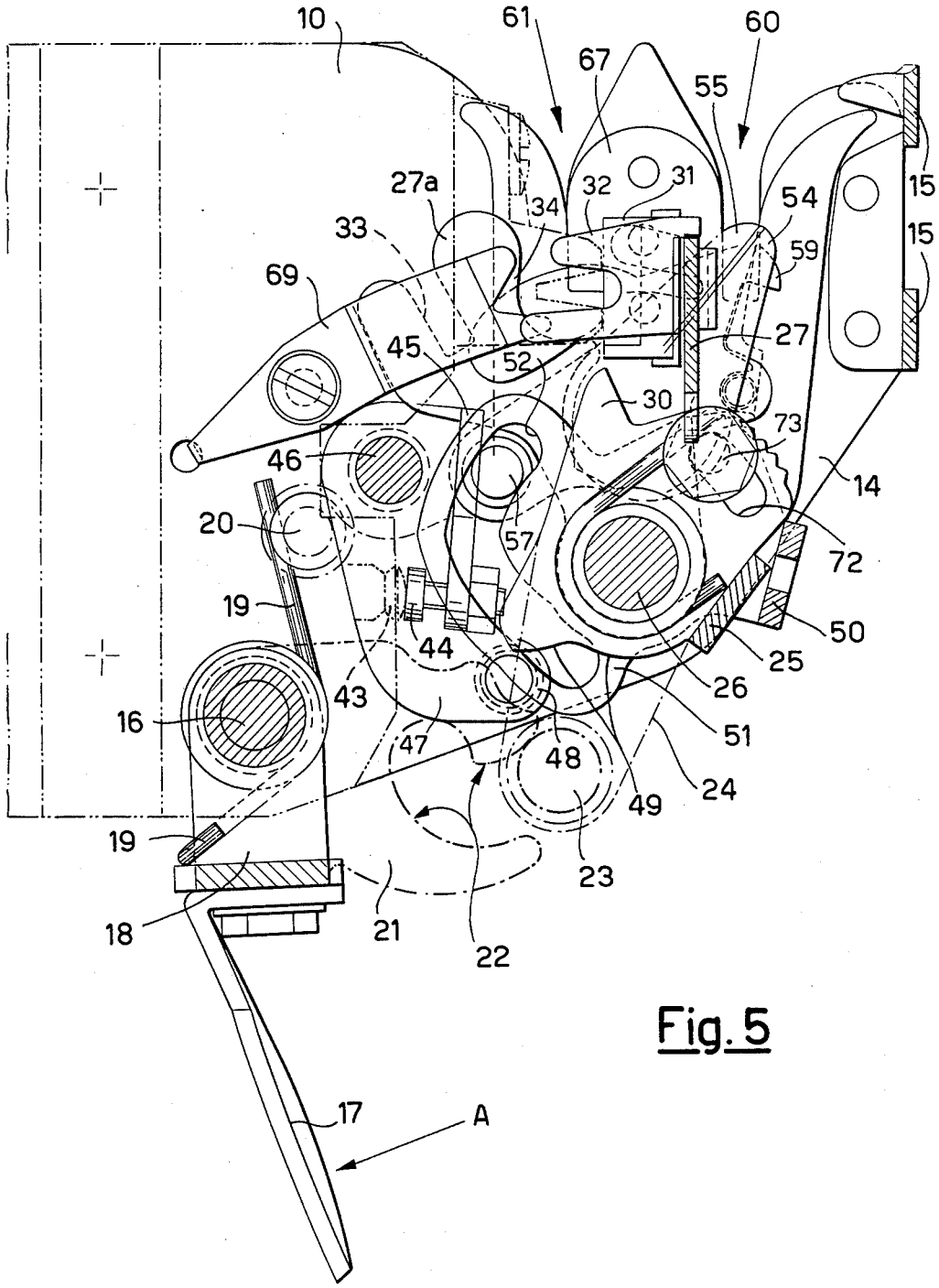

FIGS. 3 to 5 inclusive show the device, after the withdrawal of a sidewall, in three sequential working conditions.

Figure 6:
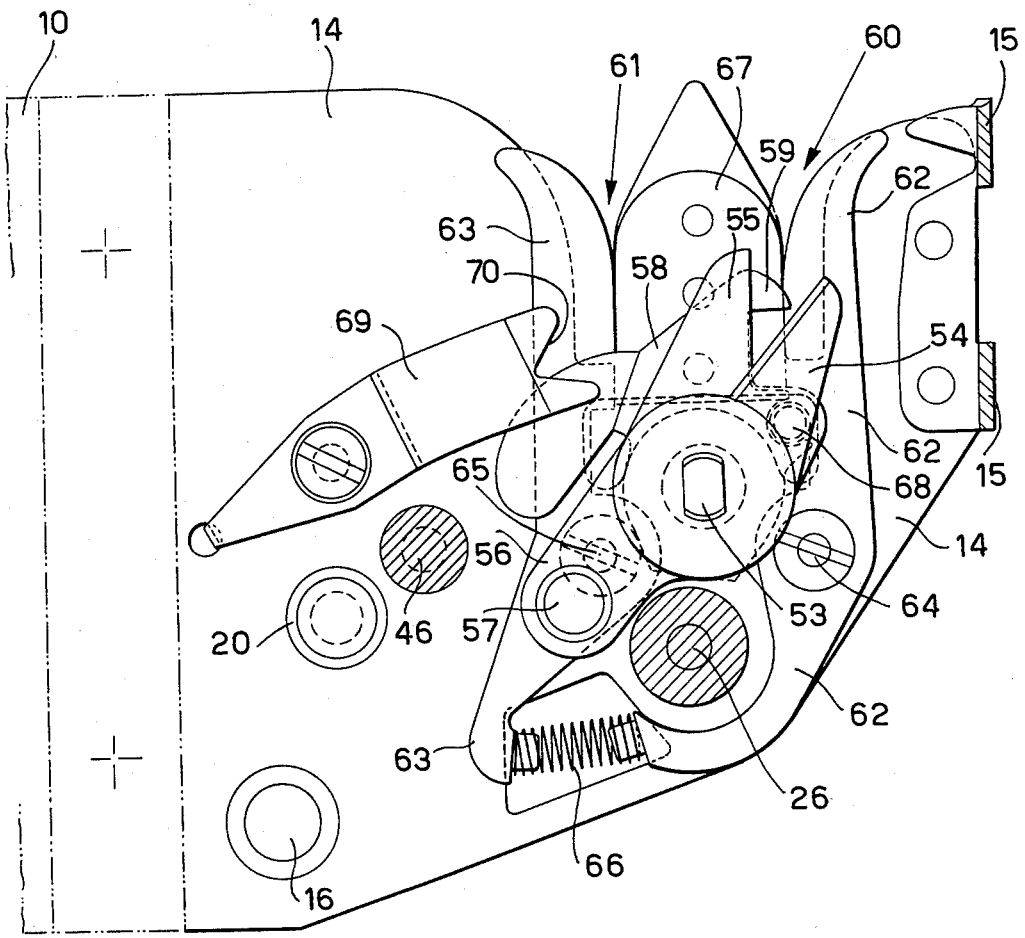
Figure 7:
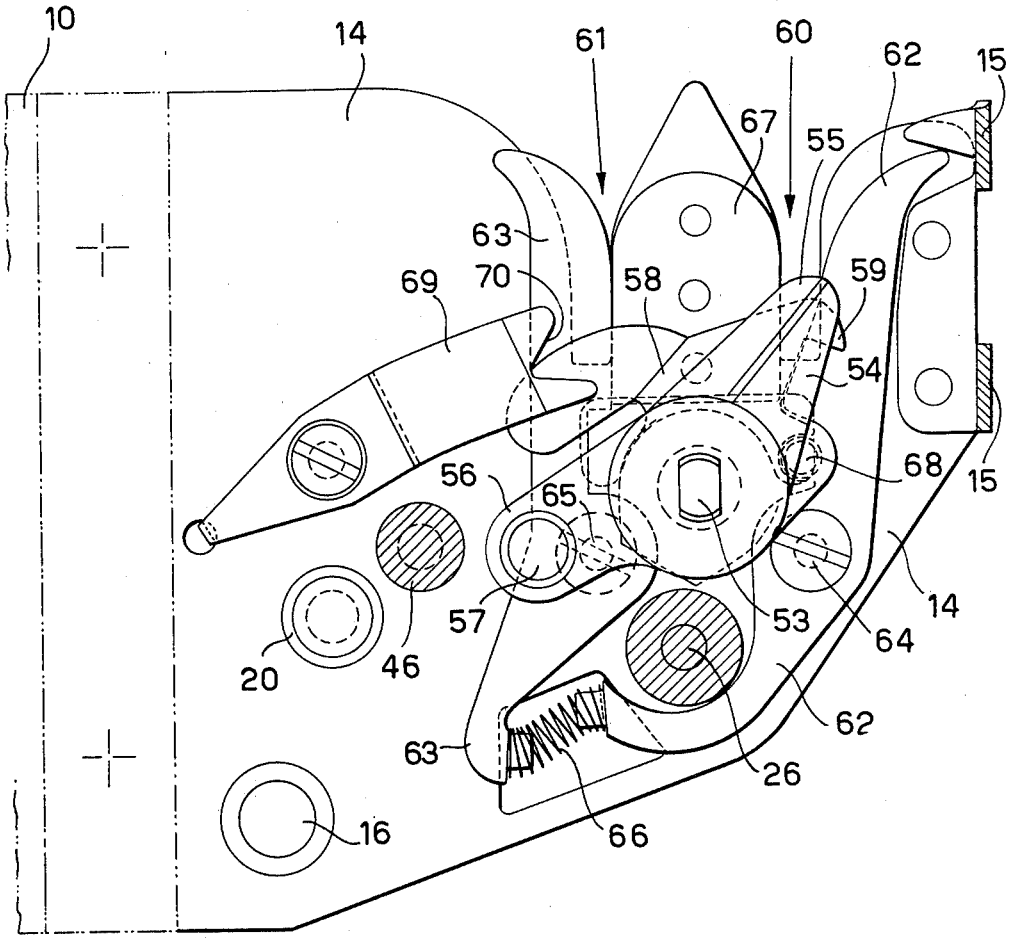

FIGS. 6 and 7 show, as viewed from the interior, a sidewall of the device with the members carried thereby, in two sequential working conditions.

Figure 8:
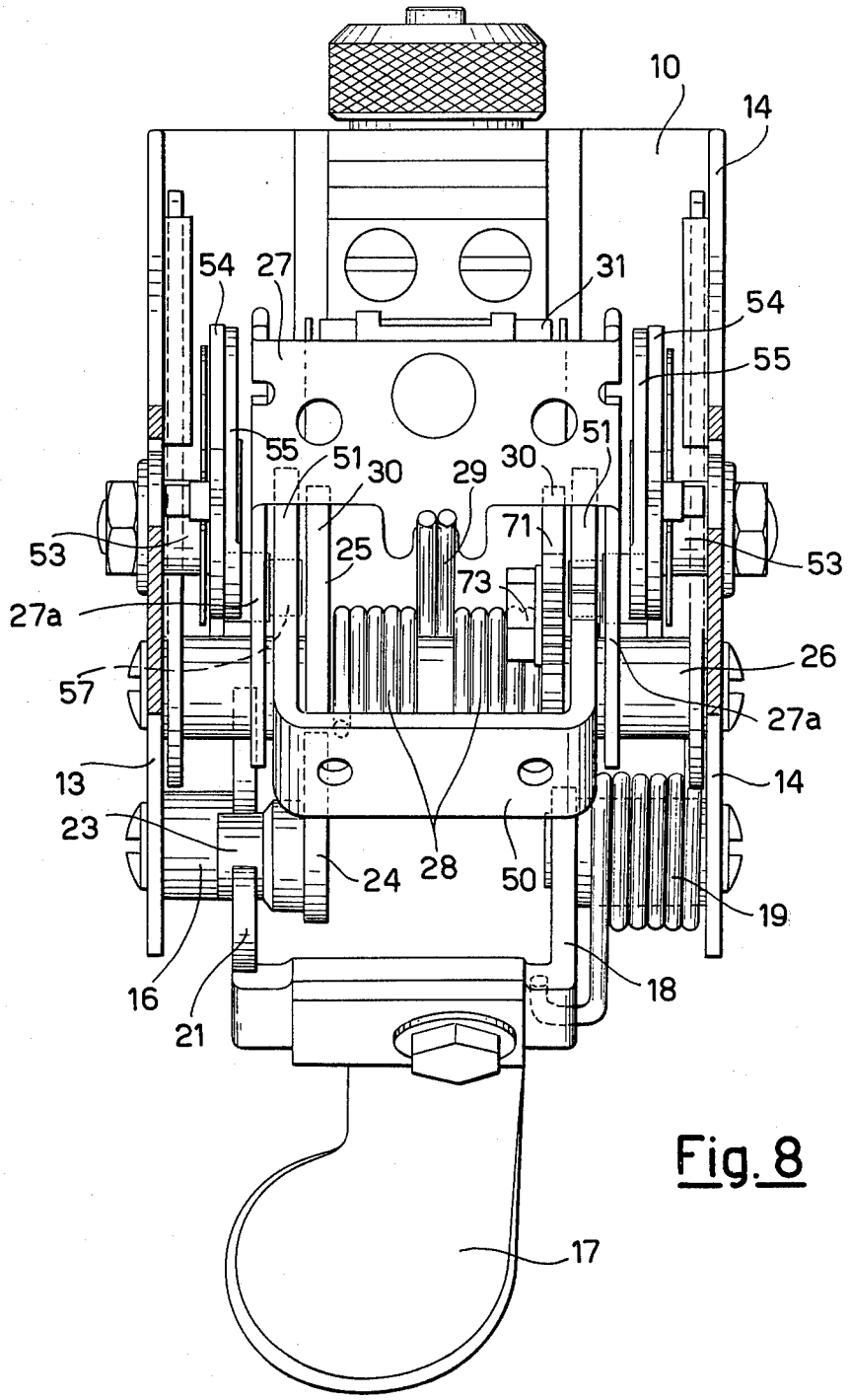

FIG. 8 is a front view, partly in cross-section taken along the line VIII—VIII of FIG. 4.

Figure 9:
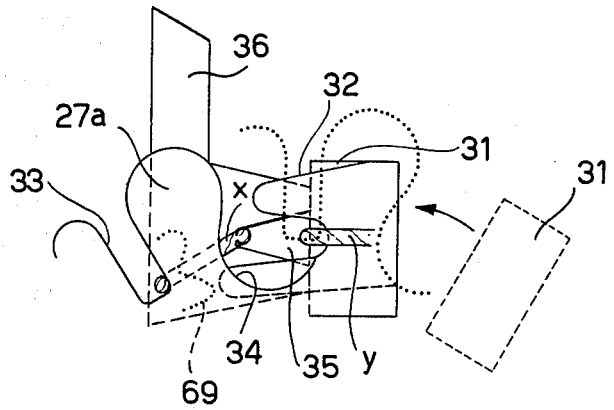
Figure 10:
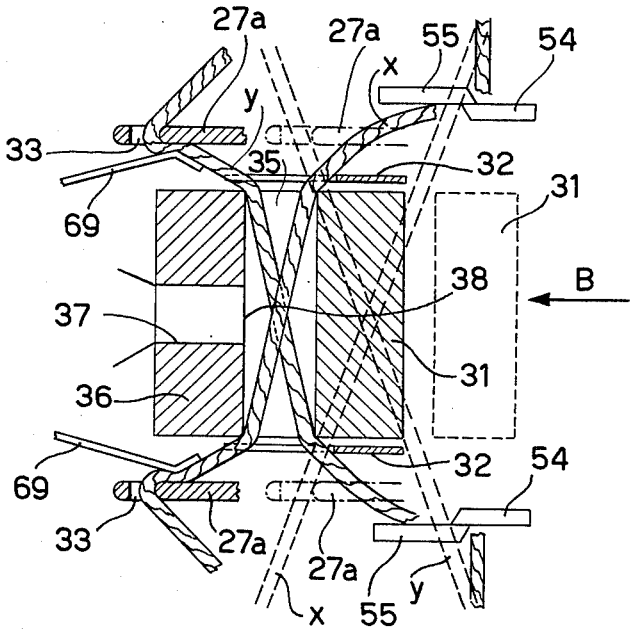

FIGS. 9 and 10 show diagrammatically, in side elevation and in plan view, partly in cross-section, the stages of introduction, positioning and severing of the yarns in the device.

Figure 11:
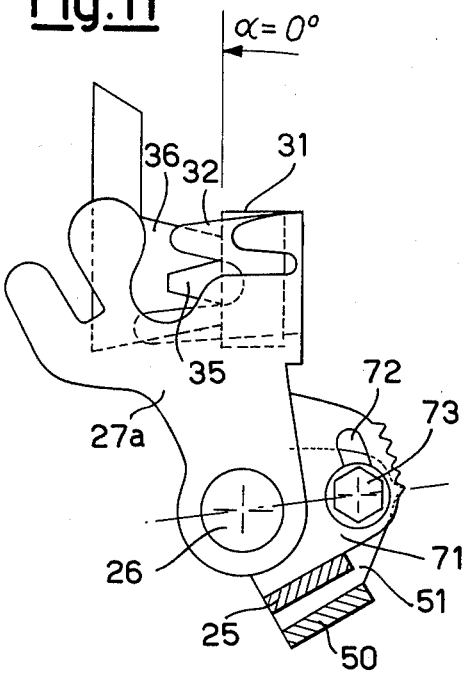
Figure 12:
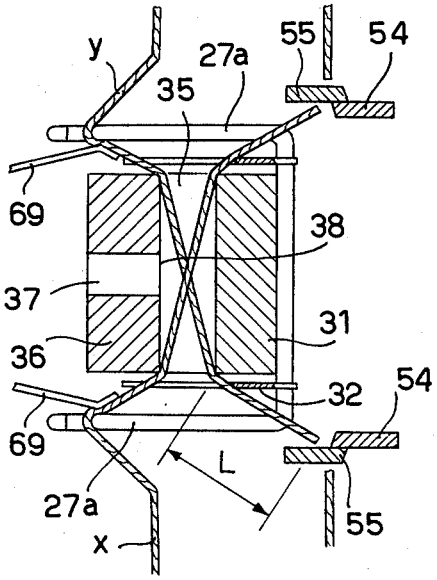

FIGS. 11 and 12 likewise show, as in FIGS. 9 and 10, the severing stage of the tails of the yarns in a first adjustment condition, and FIGS. from 13 to 16 inclusive are views akin to those of FIGS. 11 and 12 but in other two conditions of severing adjustment.

The device shown in the drawings is of the manually controlled type, with a control trigger, and is intended for being worn on the hand of an operator.

The device consists of a main body 10 which contains the pneumatic unit which is of no interest for the present invention and thus is not described in detail herein. The body 10 has a strap 11 for hand wear and a tube 12 to be connected to a source of compressed air (not shown). To the body 10 there are secured two sidewalls 13, 14 which are connected together by a shielding cross tie 15 and, between these sidewalls there is mounted the mechanical unit to be described in detail hereinafter.

FIGS. from 3 to 5 inclusive show the mechanical unit under several working conditions, after having removed the sidewall 13, whereas the FIGS. 6 and 7 show, as viewed from inside, the sidewall 14 only, with the members carried thereby.

It should be observed that the device is quite symmetrical, that is to say, that the sidewall 13 carries in the interior the same component parts as the sidewall 14.

A transversal shaft 16 mounted between the sidewalls 13 and 14 carries for rotation a stirrup 16 to which a trigger 17 is integrally secured (see also FIG. 8). A spring 19 which is active between an abutment 20 (FIG. 3) and the stirrup 18 maintains the latter in the position of FIG. 3 and permits its rotation by pressing the trigger 17 in the direction of the arrow A (clockwise, as viewed in FIG. 3). On either side, the stirrup 18 carries an arm 21 which exhibits an open slot 22 having a cammed outline, in which a pin 23 integral with an arm 24 is inserted, said arm, in its turn, being integral with a stirrup 25 which is borne for rotation about another transversal shaft 26 mounted between the sidewalls 13, 14. A bracket 27 is also mounted for rotation on the shaft 26 and between said bracket 27 and the stirrup 25 there is active a helical spring 28 coiled about the shaft 26: the spring rests with either end against the stirrup 25 and with the other end 29 urges the bracket 27 against protrusions 30 of the stirrup 25.

The bracket 27 carries on its transversal section and loosely a lid 31 for closing the blending chamber, to be described hereinafter, and laterally of the lid 31 and integral therewith two thread guides 32 are provided. The shaped side webs **27*a* of the bracket 27, in their turn, exhibit, each, two throats 33, 34** wherein the yarns to be spliced are inserted, and which thus act as thread-shifting members as will be described in more detail hereinafter.

The blending chamber 35 which, in cross-section, has a substantially V-shaped outline (see more particularly FIG. 3) is formed through a block 36 secured centrally to the body 10. In this chamber 35 there opens centrally and in correspondence with its bottom wall a duct 37 (see also FIGS. 10, 12, 14 and 16) through a port 38, the duct 37 leading to a cutoff valve 39 of a feed conduit 40 for compressed air, to which the tube 12 is connected. The valve 39 is kept closed by a spring 41 and its stem 42 emerges frontally with an actuation knob 43 from the main body 10.

By pressing the knob 43 and shifting the stem 42 against the bias of the spring 41, the valve 39 is opened and permits the flow of compressed air from the conduit 40 into the duct 37 and, through the port 38 into the blending chamber 35.

For commanding the actuating knob 43 of the valve 39 a presser 44 is provided which is adjustably borne by a small bracket 45 mounted oscillably about a third transversal shaft 46 arranged between the sidewalls 13, 14. The small bracket 45 has an arm 47 carrying a pin 48 held in contact with a cam profile 49 integral with the stirrup 25 on the side away of the arm 24.

The pin 48 is held in contact with the cam profile 49 by the bias of the spring 41 which urges the stem 42 of the valve 39 with the knob 43 against the presser 44 carried by the small bracket 45.

On the stirrup 25 there is mounted in an angularly adjustable position a bracket 50 the side webs 51 of which have, each, a slot 52 with a cammed outline which serves to control the movable scissors blade mounted on the respective confronting sidewall, 13 or 14, respectively. These command slots 52 are identical on the two sides of the device.

There will now be described with reference to FIGS. 6 and 7 the members mounted on the sidewall 14 of the device, on bearing in mind that the same, identical members are likewise mounted also on the interior of the other sidewall 13.

About a pin 53 there is arranged the severing member for the free tail of either yarn, consisting of a fixed scissors blade 54 and a movable scissors blade 55. The movable scissors blade 55 has, integral therewith, an arm 56 which carries a pin 57, the latter being inserted in its respective cammed slot 52. A rotation of the stirrup 25 with its bracket 50 and its web 51 through which the slot 52 has been formed, in the anticlockwise direction (as viewed on FIG. 3) about the transversal shaft 26 causes a clockwise rotation (as viewed on FIG. 6) of the arm 56 with the movable scissors blade 55 about the pivot 53. A spring member 58 mounted for rotation about the pin 53 together with the movable scissors blade 55 urges the latter resiliently against the fixed scissors blade 54 and, with its hooked end 59, it retains the yarn between the two scissors blades prior to cutting.

Each sidewall 13, 14, then, has two notches, or guides 60, 61, for the initial positioning of the yarns to be spliced; of the two guides, the one on the right, 60 (as viewed on FIGS. 6 and 7), substantially corresponds to the position of the severing member 54–55 for the tail to be severed of either yarn, whereas the one on the left, 61, substantially corresponds to the position in which the other yarn is to be clamped in the manner to be described hereinafter. With each of these notches 60, 61, a pincer member cooperates, 62 and 63; respectively, as mounted oscillably about a pin, 64 and 65, respectively. A spring 66 acting between the lower ends of the two pincer members 62, 63, tends to separate these ends from one another and causes the rotation in opposite directions of the two members 62, 63 about their respective pivots 64, 65, bringing them to contact a central plate 67 mounted on the sidewall in a position between the two notches 60, 61.

Now, upon the pincer member 62 cooperating with the notch 60 which corresponds to the position of the severing member, there can act a pin 68 carried by the movable scissors blade 55 in the sense of causing said member 62 to be rotated against the bias of the spring 66 and thus to clear the notch 60 when the movable scissors blade 55 is moved towards the fixed scissors blade 54 to effect the cutting operation (see FIG. 7). The other pincer member 63, which cooperates with the second notch 61, instead, remains always adherent to the plate 67 to exert a braking action onto the yarn inserted in the notch 61.

On each sidewall 13, 14, there is mounted a leaf spring 69 having a V-shaped front outline 70. These leaf springs 69 are intended to cooperate with the side webs **27*a* of the bracket 27 to clamp the yarn ends on the introduction side of the notches 61, that is, on the side away of the one in correspondence with which the severing of the free tails is carried out. The leaf springs 69 with the respective side webs 27*a* of the bracket 27 thus form clamping members, of which the leaf springs 69 are the fixed component parts and the side webs 27*a* of the bracket 27** are the movable component parts.

It should be noted that the leaf springs 69 mounted on the two sidewalls 13, 14 of the device are confrontingly positioned and the same is true of the severing members 54, 55.

On considering the motion of the lid 31 from the position away of the blending chamber 35 (FIG. 3) to the position in which it frontally closes said chamber (FIG. 5), the direction of said motion being indicated by the arrow B in FIG. 3, it can be seen that the fixed component parts (leaf springs 69) of the clamping members are in an advanced position relative both to the blending chamber 36 and to the severing members 54, 55.

It has been said that the bracket 50–51 is mounted in an angularly adjustable position on the stirrup 25 to follow the rotary motion of the stirrup about the transversal shaft 26. To make this adjustment possible, a portion 71 integral with the stirrup 25 has a slot 72 and either side web of the bracket 50 carries a screw 73 the stank of which is inserted through said slot 72. The bracket 50–51 can thus be rotated relative to the stirrup 25 through an angle which is defined by the slot 72, to be set in the desired position by means of the screw 73. By this adjustment, it is possible properly to adjust the instant of time at which the movable scissors blades 55 carry out the severing of the free tails of the yarns during the closing motion of the lid 31, as will be better described hereinafter.

The operation of the mechanical unit of the device is as follows.

Starting from the inoperative position, as shown in FIGS. 3 and 6, and pressing the trigger 17 in the direction of the arrow A, one causes the rotation, in the direction of the arrow B, of the unit consisting of the stirrup 25, the bracket 50 secured thereto and the bracket 27 urged by the spring 28. The lid 31 is thus moved in the direction towards the block 36 through which the blending chamber 35 is formed and the cammed slots 52, through the pins 57, move the movable scissors blades 55 to effect the cutting. Concurrently, the pins 68 of the movable scissors blades 55 displaces the pincer members 62 to clear the notches 60. During this first step of the motion, the stirrup 45 remains motionless, since its feeler pin 48 lies on a constant-radius sector of the cam outline 49 of the stirrup 25. Shortly before that the lid 31 comes to close the blending chamber 35 frontally, the side webs 27*a* of the bracket 27 contact the leaf springs 69 to clamp the ends of the yarns to be spliced. Thus, the blending chamber 35 is now closed with the yarns correctly positioned, clamped and severed (FIGS. 4 and 7).

By pressing the trigger 17 farther in the direction of the arrow A, the stirrup 25 with the bracket 50 are pushed forward in the direction of the arrow B, whereas the bracket 27 remains in the position it had attained. Also the movable scissors blades 55 are no longer moved, because their pins 57 lie on a circular portion, relative to the axis of shaft 26, of the cammed slot 52. Conversely, the pin 48 of the stirrup 45 ascends on an ascending sector of the cammed outline 49 so that the stirrup 45 is caused to be rotated about the shaft 46, wherefore the presser 44 displaces the knob 43 and opens the cutoff valve 39 (FIG. 5). An air blow that enters the blending chamber 35 and brings about the splicing of the yarns positioned therewithin. The duration of this air blow can be preselected in any optional manner.

By releasing the trigger 17, all the component parts are restored to their starting positions automatically.

Having now reference to the FIGURES from 10 to 16 inclusive, the operation of the device will be described in more detail with particular reference to the positioning of the yarns and the severing of their free tails in adjustable lengths.

FIGS. 10 and 11 diagrammatically show the stages of introduction, positioning and severing of two yarns, X and Y. At the start, the lid 31 and the side webs 27*a* of the bracket 27 are in the positions shown in dotted lines. The two yarns X and Y are positioned crossed over one another (see the dotted lines), with the yarn X inserted in the notch 61 of the sidewall 13 and in the throat 33 of the web 27*a* adjoining the sidewall 13, whereas the free tail of the yarn is inserted in the throat 34 of the web 27*a* adjoining the sidewall 14, between the movable scissors blade 55 and the fixed scissors blade 54 of the severing member mounted on the sidewall 14 (where it is retained by the hook 59 of the spring 58), and in the notch 60 of the sidewall 14. The yarn Y is inserted in the notch 61 of the sidewall 14 and in the throat 33 of the web 27*a* adjacent to said sidewall 14, whereas its free tail is inserted in the throat 34 of the web 27*a* adjacent to the sidewall 13, between the movable scissors blade 55 and the fixed blade 54 mounted on the sidewall 13, and in the notch 60 of the latter sidewall.

By shifting the lid 31 and the side webs 27*a* of the bracket 27 in the direction of the arrow B, the two yarns X and Y are inserted in the blending chamber 35, wherein they lastly take the positions indicated in solid lines. It is clearly apparent that, while the ends of the two yarns X and Y which are held clamped between the webs 27*a* of the bracket 27 and the leaf springs 69 are kept on the bottom wall of the chamber 35, the free tails, after severing, are away of the bottom wall of the chamber 35 and adhere to the lid 31. By so doing, it is prevented, as far as practicable, that the free tails of the yarns may detrimentally interfere with the ends which are held clamped, so that the splicing operation by the air jet entering centrally through the port 38 of the blending chamber 35 is both facilitated and made more reliable. The ends of the two yarns to be spliced are correctly balanced in the chamber 35 and thus the admixture of their fibers may proceed in the manner which is required for ensuring a sturdy union, the hazard of ejection of either tail from the chamber 35 being therefore limited.

It has already been pointed out that another factor which determines the good quality and the sturdiness of a splicing between two yarns and which affords a high versatility of use to the device is that of the lengths of the free tails of the yarns after cutting.

As a matter of fact, tails which have been cut too short might easily be ejected from the blending chamber during blowing, or they might originate short and weak splices. On the contrary, tails which have been cut too long, while they improve the length and the sturdiness of the splice, may involve the shortcoming of an incomplete blending and of protruding from the spliced yarn, that is to say, that they are not completely incorporated therein. This fact might cause difficulties in the further processing of the yarn, since the latter, if it has projecting tails, would meet with exceedingly heavy hindrances when passed between the needles, and like drawbacks. As a rule, it can be said that for yarns which, by virtue of their properties, lend themselves readily to be united with the air-splicing method in point, the tails can be cut shorter, whereas, with the yarns the fiber blending of which is difficult, it is necessary to leave longer tails so as to extend the spliced joint, even at the expense of permitting that the tail ends may project from the spliced yarn.

In the FIGURES from 11 to 16, there are shown three cases of adjustment, to have tails cut at the maximum length, at an intermediate length and at the minimum length.

FIGS. 11 and 12 substantially correspond to FIGS. 9 and 10. In these FIGURES, the adjustment is provided for the maximum tail length. This is obtained by loosening the screw 73, angularly displacing the bracket 50 relative to the stirrup 25 so that the stalk of the screw 73 comes to lie at the lower end (as viewed in FIG. 11) of the slot 72, and tightening then the screw 73 anew.

By so doing, the instant of cutting by the scissors 54–44 undergoes a maximum delay and the cut takes place virtually at the same instant of time as the lid 31 reaches its end of stroke and closes the blending chamber 35 (angle alpha is zero degrees). The lengths of the free tails projecting from the chamber 35 are indicated by "L" in FIG. 12.

Figure 13:
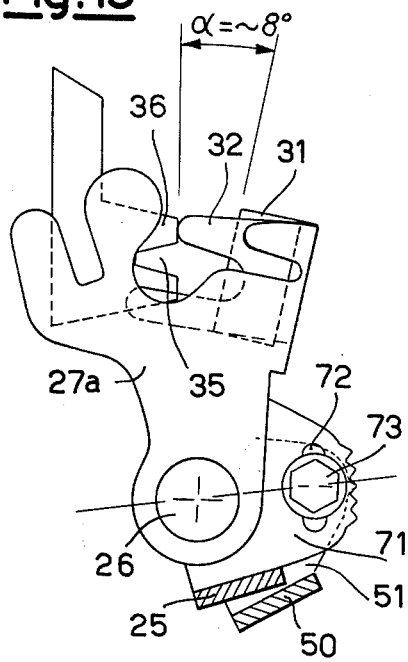
Figure 14:
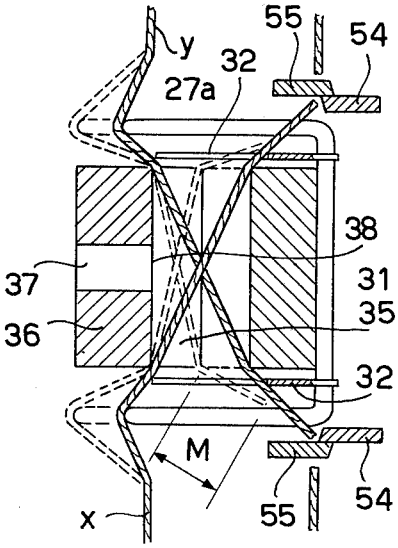

Conversely, by displacing the bracket 50 so that the stalk of the screw 73 lies at the center of the slot 72 (see FIGS. 13 and 14), the instant of time of cutting is advanced relative to closure of the blending chamber 35 by the lid 31 (angle alpha is 8° approx.), so that, during the further stroke of the lid up to its closure position (indicated in dotted line in FIG. 14), the two yarns X and Y shorten the lengths of the free tails emerging from the chamber 35 to a value indicated at "M" in FIG. 14. This fact occurs since the yarns X and Y at the side of entrance into the chamber 35 are initially held braked in the notches 61 by the action of the pincer members 63 and are then clamped between the leaf springs 69 and the side webs 27*a* of the bracket 27 and thus they cannot yield on that side, while the already severed free tails are compelled to be shortened in order that they may supply the shank necessary for the complete introduction into the chamber 35 by the action of the lid 31 and of the yarn-shifting guides in the side webs 27*a* of the bracket 27. In the former case, instead (tails of maximum length), this shank which is necessary for the complete introduction of the yarns into the chamber 35 is supplied by the free tails by virtue of the fact that these (unclamped by the action of the members 62 in correspondence with the notches 60) are already completely pushed into the blending chamber prior to cutting.

Figure 15:
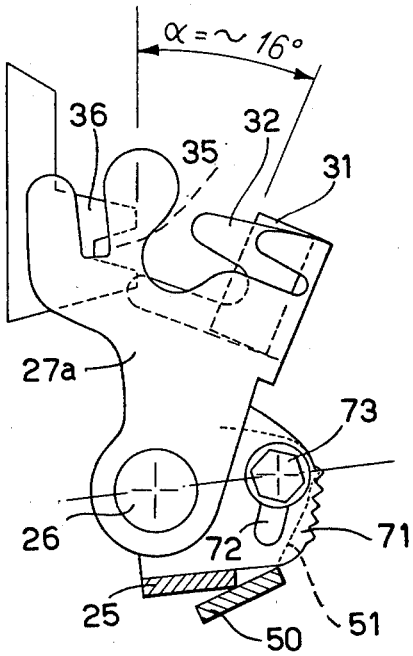
Figure 16:
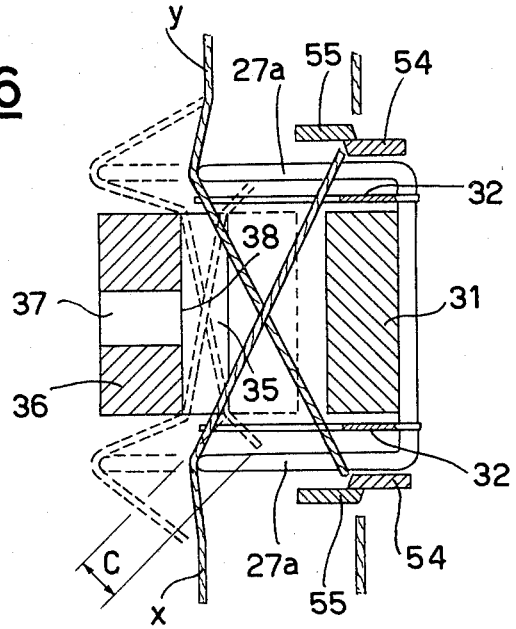

Lastly, FIGS. 15 and 16 illustrate the adjustment conditions for having tails of minimum length (indicated at "C" in FIG. 16) as obtained for displacing the bracket 50 relative to the stirrup 25 until the stalk of the screw 73 is at the top end of the slot 72. In this case, the cut of the tails by the scissors 54–55 takes place with an angle of advance of about 16° relative to the closure position of the lid 31.

It should be noted that, in the case of a tail cutting advanced relative to the position of closure of the lid 31, during the remaining closure stroke thereof, the cut tails would remain free and left loosely and thus it would be impossible to guarantee their correct final positioning in the blending chamber 35. Instead, for guaranteeing also in this case the desired positioning of the free tails spaced from the clamped yarn ends, there are provided the thread guides 32 arranged directly at the two sides of the lid 31, which guide the cut free tails towards their correct position.

The invention is not restricted to a portable hand controlled device such as described hereinbefore, but, as it is obvious, it is applicable also to a device mounted in fixed position at an appropriate location and equipped with an appropriate mechanical, electromechanical or like control means.

I claim:

1. A device for splicing textile yarns by admixing and intermingling the component fibers thereof with the aid of compressed air, comprising a blending chamber having a substantially V-shaped cross-sectional outline, with an opening formed centrally in correspodence with the bottom wall thereof and connected via a cutoff valve to a source of compressed air, a lid borne by a movable supporting member for closing said chamber frontally, means for shifting said lid from an inoperative position away of the chamber to a chamber closing position and vice versa, means synchronized with said lid-shifting means for opening said valve during a preselected time when the lid is in its closed position, fixed guideways for positioning the yarns to be spliced and placed at both sides and away of the blending chamber, members comprised of fixed and movable portions for clamping the yarns and severing means comprised of fixed and movable scissors blades for severing the free tails of the yarns on the opposite side as referred to the chamber and relative to the clamping side, the movable portions of the clamping members and the movable scissors blades of the severing members being controllable in synchronization with the movement of said lid from its inoperative position to the position of closure of the blending chamber, the device being characterized in that the fixed portions of the clamping members and the severing members, respectively, on the two sides of the blending chamber are mutually confronting, that the fixed portions of the clamping members are arranged in an advanced position relative to the direction of motion of the lid from its inoperative position to its closure position, with reference to the blending chamber and also relative to the severing member, and that the supporting members for the lid carries in an adjustable position actuating means for the movable scissors blades.

2. Device according to claim 1, characterized in that the blending chamber is arranged between two supporting sidewalls for the fixed members and the movable members, that each of said sidewalls has two notches for positioning the yarns arranged substantially in correspondence with the relative clamping and cutting members, that with each of said notches cooperates a clamping member and that the clamping members associated with the notches corresponding to the cutting members are functionally connected with the movable scissors blades of said cutting members so that they are controlled to clear the respective notches when the movable scissors blades are moved towards the respective fixed scissors blades.

3. Device according to claim 1, characterized in that the supporting member for the lid consists of two portions movable relative to one another and connected by resilient means, one portion of which carries the lid and the movable members of the yarn-clamping members, whereas the other portion carries the means for actuating the movable scissors blades, said second portion being directly connected to the lid-shifting members and transferring the drive to the first portion by said resilient means until the lid attains its closure position, whereafter the second portion can effect, alone, a further displacement stroke.

4. Device according to claim 3, characterized in that said first section of the supporting member consists of a bracket mounted for rotation about a shaft having its axis parallel to the longitudinal axis of the blending chamber, said bracket having a cross-tie on which the lid is mounted loosely and two side walls each having throats for guiding the yarns, said side walls forming the movable parts of the yarn-clamping members, the fixed portions of which are leaf springs fastened to the interior of the side walls.

5. Device according to claim 4, characterized in that said second portion of the supporting member is a stirrup mounted for rotation about the same shaft as said bracket, said resilient means consisting of a helical spring mounted on said shaft and engaged with its ends with the stirrup and with the bracket, respectively.

6. Device according to claim 5, characterized in that on said stirrup there is arranged a bracket with two side webs having each a slot with a cammed profile in which there is engaged a pin integral with the movable scissors blade of the severing member alongside the respective side web of the bracket and mounted on the respective side wall of the device.

7. Device according to claim 6, characterized in that the stirrup has on its portion adjacent to a web of the bracket a slot which engages the stalk of a screw screwed into said bracket web for locking the bracket on the stirrup in an adjustable angular position.

8. Device according to claim 5, characterized in that said stirrup has a cammed profile contacting a feeler member for controlling the cutoff valve for the flow of air into the blending chamber.

9. Device according to claim 4, characterized in that the transversal portion of said bracket carries thread-guides at the two sides of the lid.

10. Device according to claim 3, characterized in that said second portion of the lid-supporting member has a projecting pin which is in engagement with a cammed throat provided in an actuation member consisting of a rotatable stirrup provided with a trigger control.

* * * * *